US006024653A

United States Patent [19]

Goodrich

[11] Patent Number: 6,024,653

[45] Date of Patent: Feb. 15, 2000

[54] HEEL-TO-TOE BALANCED GOLF CLUB HEAD

[76] Inventor: Burton J. Goodrich, 11205 SW. Summerfield Dr., Tigard, Oreg. 97224-3388

[21] Appl. No.: 09/020,346

[22] Filed: Feb. 9, 1998

[51] Int. Cl.[7] ..... A63B 53/02; A63B 53/04

[52] U.S. Cl. ..... 473/314; 473/338; 473/349

[58] Field of Search ..... 473/312, 313, 473/314, 334, 335, 336, 337, 338, 339, 341, 349, 350

[56] References Cited

U.S. PATENT DOCUMENTS

| | | | |
|---|---|---|---|
| 723,534 | 3/1903 | Knight | 473/314 |
| 1,518,316 | 12/1924 | Ellingham | 473/337 |
| 2,067,556 | 1/1937 | Wettlaufer | 473/314 |
| 2,683,036 | 7/1954 | Klein . | |
| 3,064,980 | 11/1962 | Steiner . | |
| 3,967,826 | 7/1976 | Judice | 473/313 |
| 4,607,846 | 8/1986 | Perkins | 473/312 |
| 4,655,459 | 4/1987 | Antonious | 473/341 |
| 5,050,879 | 9/1991 | Sun | 473/338 |
| 5,199,707 | 4/1993 | Knox | 473/314 |
| 5,205,553 | 4/1993 | Okumoto | 473/312 |
| 5,542,666 | 8/1996 | Chou | 473/314 |

*Primary Examiner*—Sebastiano Passaniti
*Attorney, Agent, or Firm*—Olson and Olson

[57] ABSTRACT

A golf club head is provided with a forwardly facing ball-striking face and a shaft-anchoring bore having a longitudinal axis disposed forwardly of the ball-striking face. A plane located on the longitudinal axis and extending perpendicular to the ball-striking face divides the head into a heel portion and a toe portion, and weight is added to the heel portion to provide the heel portion with a total weight equal to the total weight of the toe portion.

5 Claims, 1 Drawing Sheet

HEEL-TO-TOE BALANCED GOLF CLUB HEAD

BACKGROUND OF THE INVENTION

This invention relates to golf clubs, and more particularly to a golf club head characterized by heel-to-toe balance.

Golf clubs heretofore have been characterized by such qualities as low center of gravity, perimeter weighting, lightweight metals and others. All of them also are characterized by significantly greater weight of the toe area than of the heel area. It is because of this greatly unbalanced arrangement that such efforts as perimeter weighting have been attempted to increase the effective hitting area of the face of the golf club.

SUMMARY OF THE INVENTION

The golf club head of this invention is characterized by having equal heel and toe weight on opposite sides of the longitudinal axis through the golf club shaft.

The principal objective of this invention is to provide a golf club head in which heel-to-toe balance replaces perimeter weighting and enlarges still further the effective hitting area of the face of the head.

Another objective of this invention is the provision of a golf club head in which heel-to-toe balance is achieved for all shapes and sizes of golf club heads.

A further objective of this invention is to provide a golf club head having heel-to-toe balance and which is of simplified construction for economical and precise construction.

The foregoing and other objects and advantages of this invention will appear from the following detailed description, taken in connection with the accompanying drawings of a preferred embodiment.

DESCRIPTION OF THE PREFERRED EMBODIMENT

Figure 1:
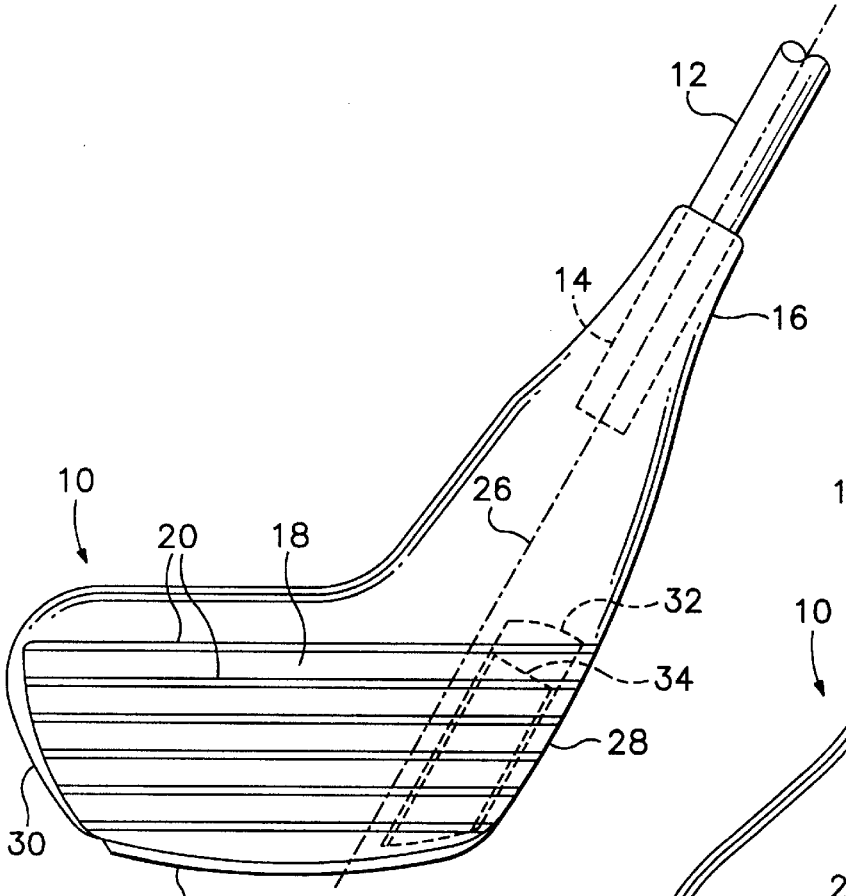
FIG. 1 is a fragmentary front elevational view of a golf club head characterized by heel-to-toe balance to opposite sides of the longitudinal axis of an associated golf club shaft.
Figure 2:
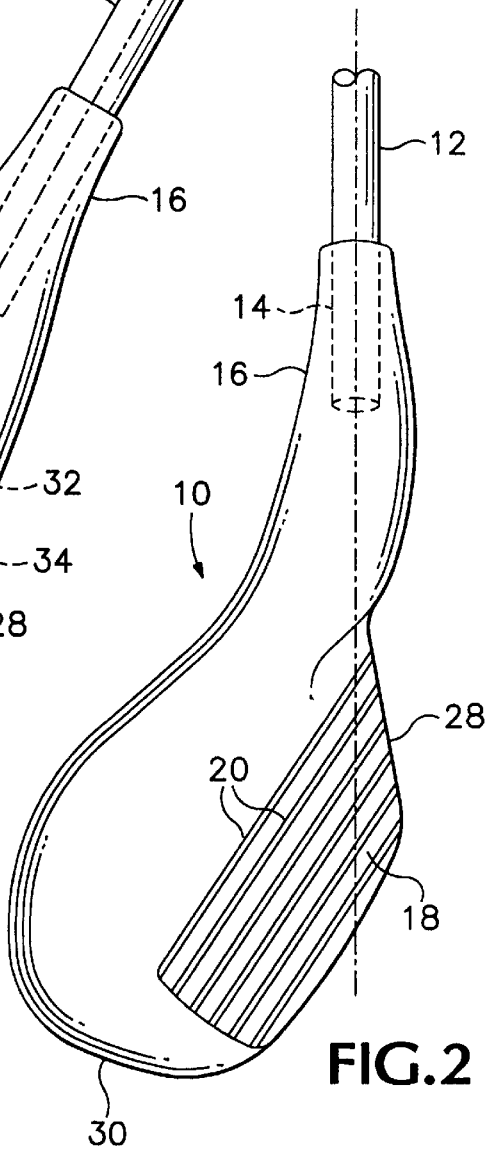
FIG. 2 is a fragmentary perspective view of the golf club head and shaft of FIG. 1.

Referring to the drawings, the golf club illustrated includes an enlarged head 10 and an elongated shaft 12 secured to and extending from an anchor bore 14 in the hosel 16 of the head. The shaft terminates in a flexible hand grip component (not shown). The head is formed with a forwardly facing ball striking face 18 provided with conventional grooves 20 for striking a golf ball (not shown). The head also has a back portion 22 providing the mass of the head, and a sole plate 24 for engaging the ground.

A plane located on the longitudinal axis 26 through the bore 14 and shaft 12 and disposed perpendicular to the face

18 of the head, divides the head into a heel portion 28 and a toe portion 30. Because of structural requirements established by the United States Golf Association rules, that the heel 28 must not project rearwardly from the axis 26 of the shaft more than 0.625 inch (1.6 cm), most of the mass of the head necessarily must be contained in the toe portion 30. Accordingly, in accordance with this invention, the heel portion 28 is provided with additional weight sufficient to bring the heel portion to a weight matching the weight of the toe portion 30.

In the embodiment illustrated, the heel portion 28 is provided with a hollow chamber 32 in which one or more weights 34 may be installed, to arrive at the heel-to-toe weight balance. The sole plate 24 may be removed to expose the chamber and weights. The amount of weight required to be filled into the hollow chamber varies with different golf clubs head sizes and configurations. In all cases, however, the amount of weight must be sufficient to provide the heel portion of the club head with a total weight equal to the total weight of the toe portion. This condition is demonstrated by being able to balance the golf club at a point on the shaft, with the face 18 facing vertically upward.

Figure 3:
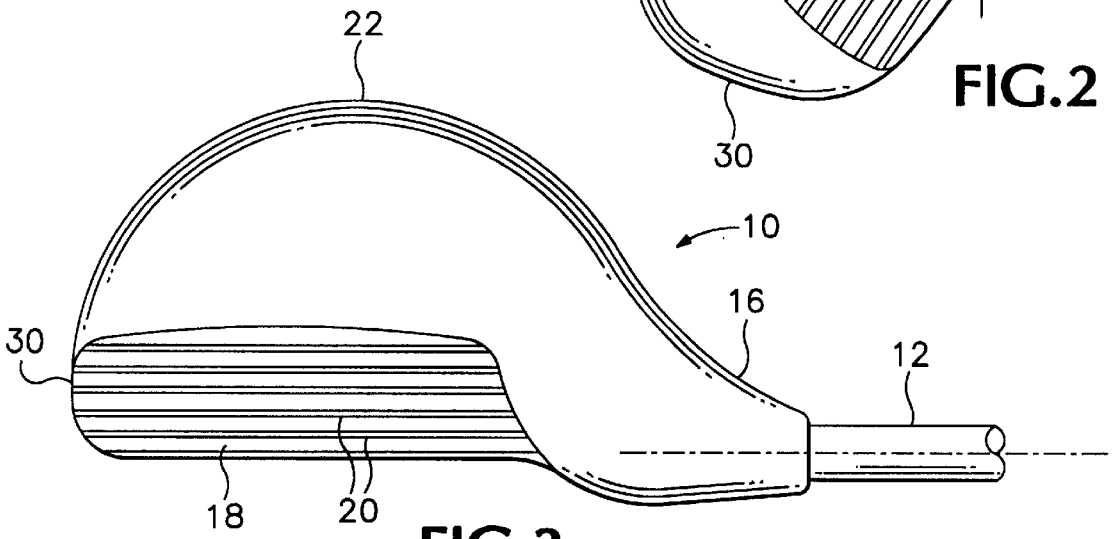
FIG. 3 is a fragmentary plan view as viewed from the top in FIG. 1.

As best shown in FIG. 3, the ball striking face 18 is offset rearwardly of the longitudinal axis 26 of the bore 14 and shaft 12. This configuration promotes solid impact with and straight flight of a struck golf ball.

It will be apparent to those skilled in the art that various modifications and changes may be made in the structural details described hereinbefore. For example, the head may be made of wood or various metals and combinations of metals. The weight 34 may be a single solid piece, a plurality of pieces, or powder. These and other changes may be made, as desired, without departing from the spirit of this invention and the scope of the appended claims.

I claim:

1. A golf club head having a ball-striking front face and a shaft-receiving bore in the head, the bore having a longitudinal axis, a plane disposed on said axis and extending perpendicular to said front face dividing the head into a heel portion extending rearwardly from said plane a distance not exceeding 1.6 cm, and a toe portion extending forwardly from said plane a distance substantially greater than said heel portion distance, and weight means added to the heel portion sufficient to provide the heel portion with the same weight as the toe portion.

2. The golf club head of claim 1 wherein the front face is offset rearwardly of the longitudinal axis of the bore.

3. The golf club head of claim 1 including a hollow chamber in said heel portion containing the weight means.

4. The golf club head of claim 3 wherein the head has a bottom side, and the head includes a sole plate on the bottom side of the head removably closing the bottom end of said chamber.

5. The golf club head of claim 1 and an elongated shaft secured in said bore and extending outwardly therefrom.

* * * * *